United States Patent [19]

Hashimoto

[11] 4,109,575

[45] Aug. 29, 1978

[54] BLASTING METHOD AND DEVICE

[75] Inventor: Hiroshi Hashimoto, Chigasaki, Japan

[73] Assignee: Tobishima Kensetsu Kabushiki Kaisha, Japan

[21] Appl. No.: 779,658

[22] Filed: Mar. 21, 1977

[51] Int. Cl.[2] ..... F42B 3/00; F42D 3/00

[52] U.S. Cl. ..... 102/22 R; 102/23

[58] Field of Search ..... 102/22 R, 23, 24 R, 102/25

[56] References Cited

U.S. PATENT DOCUMENTS

| | | | |
|---|---|---|---|
| 431,747 | 7/1890 | Kurtz | 102/23 |
| 1,738,920 | 12/1929 | Ormsby | 102/24 R |
| 3,618,520 | 11/1971 | Hamasaki | 102/23 |

FOREIGN PATENT DOCUMENTS

| | | | |
|---|---|---|---|
| 20,445 of | 1912 | United Kingdom | 102/22 |

*Primary Examiner*—Verlin R. Pendegrass

*Attorney, Agent, or Firm*—Ladas, Parry, Von Gehr, Goldsmith & Deschamps

[57] ABSTRACT

Blasting devices, each comprising an explosive substance, a deflector, and a casing containing an incompressible fluid, the explosive substance, and the deflector are inserted into respective holes bored in a rock or the like at spaced apart positions, a tamper being thereafter stuffed in each hole, and the explosive substances in the holes are detonated simultaneously. A shock wave or blast wave is thus created in the incompressible fluid in each hole, and is deflected by the deflector in a direction along which the rock or the like is to be fractured. An improved construction of the blasting device for practicing the method is also provided.

3 Claims, 6 Drawing Figures

BLASTING METHOD AND DEVICE

BACKGROUND OF THE INVENTION

This invention generally relates to blasting technology, and more particularly to a method and equipment for blasting rocks, concrete structures, and the like by utilizing an incompressible fluid and deflectors, thereby transmitting the resulting impact force in desired direction.

Regardless of whether it is carried out on land or in water, blasting of rocks and the like has heretofore been carried out by using an explosive such as dynamite and utilizing the energy released thereby upon exploding.

Such a conventional blasting technique, however, involves various problems such as scattering of rock fragments, dust, and the like in all directions, which, on land, can cause injury to man and beast, natural resources such as forests, and agricultural products and, in water, can destroy fishing resources and fishing grounds, thus giving rise to a public pollution problem.

So-called pollution-free blasting techniques utilizing mild-speed explosives (such as CCR and SLB) have been proposed for eliminating such problems. However, the unit price of a mild-speed explosive is about ten times that of dynamite, and when the coats are compared on the basis of the explosion energy, the cost of using the mild-speed explosive is further elevated to even 50 times that of using dynamite, thus increasing the unit cost of the blasting operation itself.

Furthermore, the mild-speed explosive substances are available on the market in the form of packages each containing a predetermined quantity of the same substance. It is therefore difficult to use an appropriate quantity for the size and strength of the rock or the like to be blasted. When the mild-speed explosive substance is used in an excessive quantity relative to the size and strength of the rock or the like, the fragments tend to be scattered around the blasting area as in the case of the conventional explosive.

SUMMARY OF THE INVENTION

An object of this invention is to provide a blasting method and a device for carrying out the blasting method, wherein fragments of rock or concrete are not scattered around at the time of blasting, thus eliminating all harmful effects on the surrounding area, and wherein the rock or concrete structure is fractured along a desired direction into a desired size with minimum quantity of the explosive substance.

More specifically, the energy released at the time of the explosion acts on the rock or the like via an incompressible fluid, thereby breaking the rock by impact force transmitted through the fluid. Furthermore, the blast energy of the explosion is made directional so that the rock or the like can be fractured along a desired direction.

According to one aspect of the present invention, there is provided a method for blasting a rock or the like, comprising the steps of boring holes in the rock or the like at positions spaced apart by specific distances, inserting an explosive substance and a casing containing an incompressible fluid in each hole, stuffing a pressure preserving temper in the hole, and exploding the explosive substance in all holes simultaneously thereby creating an shock wave in the fluid in each hole, which wave is transmitted therethrough to apply an impact force perpendicular to the peripheral wall of each hole.

In another aspect of the present invention, there is provided a device for blasting rock or the like, which comprises a deflector having at least one concave reflecting surface which a semicircular cross-section, an explosive substance accompanied by a detonator secured within the concave semicircular reflecting surface, and a casing containing an incompressible fluid, whereby when the explosive substance is detonated, a shock wave is created and transmitted through the incompressible fluid in a direction along which the rock or the like is to be fractured.

The invention will be more clearly understood from the following detailed description when read in conjunction with the accompanying drawings wherein like members and parts are designated by like reference numerals and characters.

DETAILED DESCRIPTION OF THE INVENTION

Figure 1:
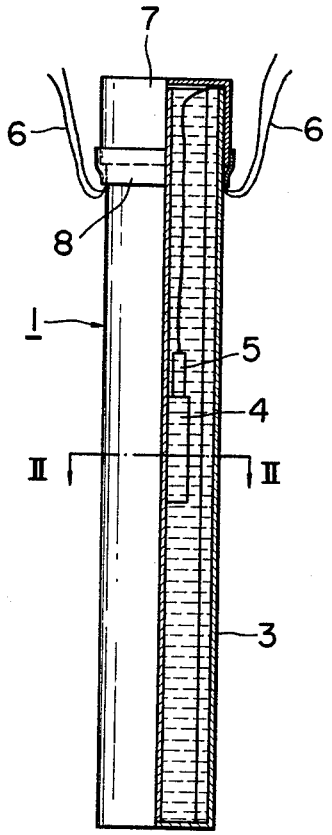
FIG. 1 is a side view, with a half shown in longitudinal section, of a blasting device constituting one unit element in a preferred embodiment of the invention.
Figure 3:
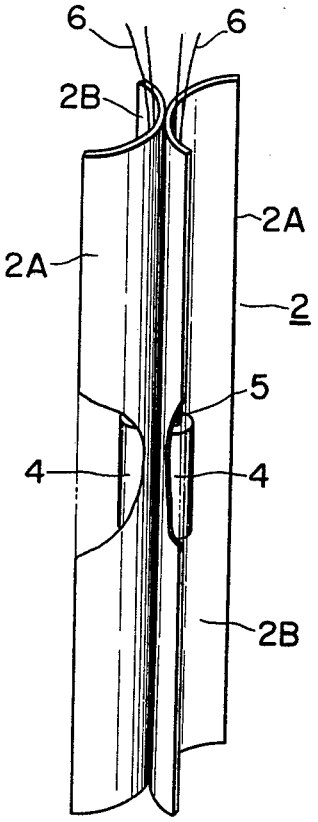
FIG. 3 is a perspective view, partly cut away, of impulsive wave deflectors used in each blasting device.
Figure 2:
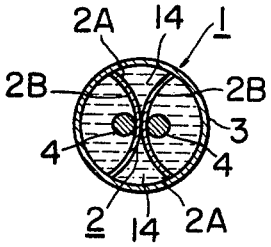
FIG. 2 is a cross-sectional view taken along the line II—II in FIG. 1.

Referring now to FIGS. 1, 2, and 3, one example of a blasting device 1 according to one aspect of the present invention comprises a cylindrical casing 3 made of a synthetic resin such as vinyl chloride, and a deflector 2 encased in the cylindrical casing 3. The deflector 2 may comprise two reflecting plates 2A made of steel plate, each having a semicircular shape in cross section perpendicular to its longitudinal axis. The two reflecting plates 2A are coupled together in a back-to-back relation. That is, the rear convex sides of the two plates 2A are secured together, by welding or by means of screws and nuts, so that the reflecting surfaces 2B on the front concave sides of the reflecting plates 2A are disposed symmetrically on one line but face in opposite directions.

Two packs of explosive substance 4 such as dynamite, each accompanied by an electric blasting cap 5 for detonation thereof, are secured respectively within the two concave surfaces 2B of the reflecting plates 2A at central positions thereof. Electric wires 6 connected to the blasting caps 5 are led out of the casing 3 through a part between the casing 3 and a cover 7 provided for the casing 3, and are connected with an electrical detonating device (not shown).

The interior of the casing 3 is filled with an incompressible fluid such as water, and the joined parts of the casing 3 and the cover 7 are sealed in a fluid-tight manner either by an application of an adhesive tape or by forming the parts into a screw-thread engageable construction.

Figure 4:
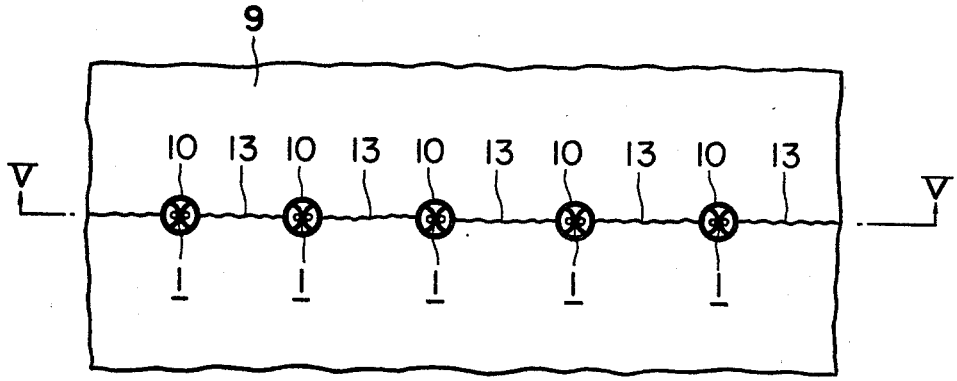
FIG. 4 is a diagram showing a plurality of blasting devices, each as shown in FIG. 1, arranged in holes in a rock or the like and also a fracture created in the rock or the like after the explosion of the blasting devices.
Figure 5:
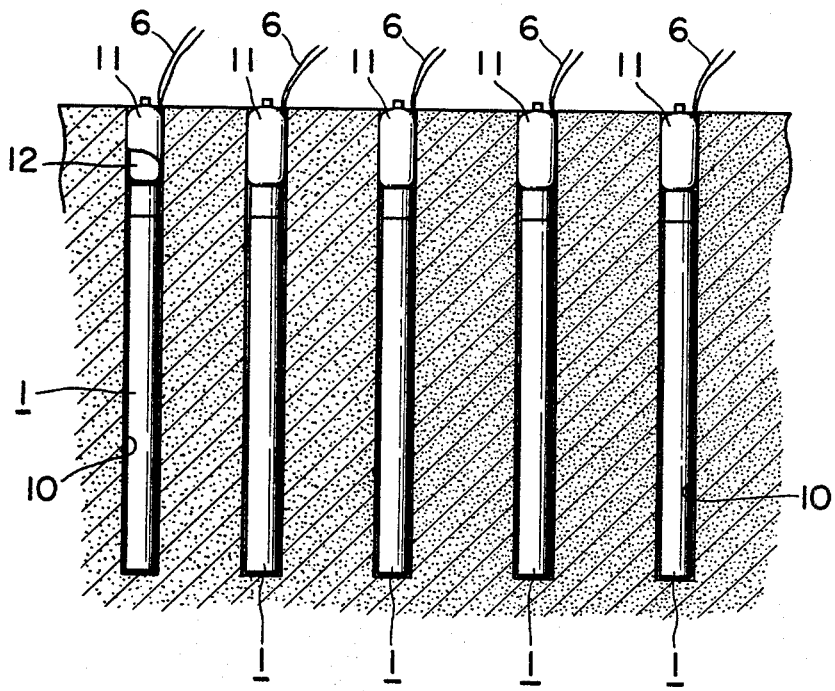
FIG. 5 is a sectional view taken along the line V—V in FIG. 4.

One example of the blasting method according to this invention in which the blasting device 1 is used will now be described in detail with reference to FIGS. 4 and 5.

A plurality of holes 10 are bored in an object 9 such as a rock to be blasted, such as a rock mass, concrete structure, or the like, at positions spaced apart by a specific distance. The depth of the holes is selected to be approximately twenty percent longer than the length of the above described blasting device.

One blasting device 1 is inserted in each of these holes 10, so that the reflecting directions of the reflecting plates 2 in all holes 10 coincide.

After this insertion, a tamping substance (hereinafter referred to as a tamper) 11 is stuffed into the opening of each hole 10. The tamper 11 may be made of a tube 12 made of, for instance, vinyl, rubber, or the like and of a construction such that, when the tamper is inserted in the opening part of the hole and filled with compressed air, sand, clay, or the like, the diameter thereof increases slightly thereby assuring firm seizure of the tamper by the inner wall surface of the hole 10. Preferably, circumferential recesses and projections may be provided on the tamper for increasing the resistance of the tamper against its movement out of the hole 10 at the time of explosion from the open end of the hole 10.

Figure 6:
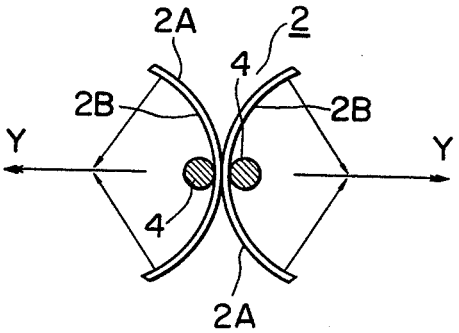
FIG. 6 is a diagram showing the direction of the deflection of the impulsive waves created in an incompressible fluid by two deflectors placed back-to-back.

At the time of blasting after the insertion of a blasting device 1 into each hole 10, as described above, the aforementioned detonating device is operated to cause an electric current to flow through the blasting caps 5 of all blasting devices 1 thereby exploding the explosive substances 4. The energy generated by the explosion in each blasting device 1 causes shock waves to be transmitted through the water in the casing 3, and, because of the incompressible nature of the water in the casing 3, the energy acts uniformly on the inner wall surface of the hole 10. Furthermore, the shock waves caused by the explosion are reflected by the reflecting surfaces 2B of the deflector 2, and the impact forces are combined as shown in FIG. 6 on a part of the inner wall surface of the hole 10.

The impact forces thus combined act collectively in the arrow distance Y on the object 9 to be broken, thus creating cracks 13 (FIG. 4) in the object 9 to be fractured. The cracks 13 starting from one hole 10 extend continuingly to the subsequent holes 10, and the object 9 is divided into two pieces along the line connecting the holes 10. This breaking action is accomplished instantaneously without creating fragments of the rock or the like, whereby the possibility of scattering of the fragments to the surrounding area can be substantially eliminated.

Because of the incompressible nature of water, the impact forces caused by the explosion are transmitted therein perpendicularly to the inner wall surface of each hole 10, but with a uniform distribution along the longitudinal direction of the hole 10. Furthermore, because the transmission velocity of a vibration in water is four-times higher than that in air, and the density of water is far greater than the density of air, the impulsive force in water is far greater than that in air, thus making it possible to break the rock or the like without scattering its fragments.

At the time of the explosion of the explosive substance 4, the impact force created by the explosion acts on the reflecting surface 2B of the corresponding reflecting plate 2A of the shock wave deflector 2. However, the water filling the spaces 14 (FIG. 2) defined by the rear surfaces of the reflecting plates 2A provides a reaction force counter to the impact forces, and therefore there is no possibility of the reflecting plates 2A made of thin steel plate being deformed, and of the straight line propagation, in the direction Y, of the shock wave being thereby lost.

The advantageous features of this invention will be further made apparent from the following experimental results.

Blasting of a Concrete structure:

| Thickness of the structure (cm) | Reinforcing steel rods | Diameter of holes (mm) | Distance between holes (mm) | Quantity of explosive per one hole (g) | Broken state |
|---|---|---|---|---|---|
| 15 | present | 32 | 200 | 5 packs of dynamite | complete |
| 50 | present | 32 | 250 | 50 cm of detonating fuse (containing 4g of explosive) | complete |
| 50 | present | 32 | 300 | 60 cm of detonating fuse (containing 5g of explosive) | complete |
| 50 | present | 32 | 350 | 80 cm of detonating fuse (containing 7g of explosive) | complete |

As shown in this table, even by the use of cord-shaped detonating fuses containing in their cores an explosive substance of 6,000 m/sec detonation velocity instead of dynamite for concrete structures of 50 cm in thickness, it was possible to obtain complete breakage.

Blasting of Base Rock in the Ground:

In the case of base rock, it was found that dynamite can produce better results than the detonating fuse, particularly when the base rock is made of granite having a compressive strength of 1,500 kg/cm$^2$. By varying the quantity of dynamite, cracks of different widths could be obtained as shown. However, in all cases, no scattering of fragments of the rock occurred.

| Diameter of holes (mm) | Distance between holes (mm) | Depth of holes (mm) | Least resistance line (mm) | Quantity of explosive per hole (g) | Width of cracks (mm) |
|---|---|---|---|---|---|
| 32 | 400 | 1500 | 1010 | 10 (dynamite) | 10 |
| 32 | 400 | 1500 | 1000 | 20 (dynamite) | 180 |
| 32 | 400 | 1500 | 1000 | 30 (dynamite) | 800 |

From the experimental results for both the concrete structure and the base rock, it is apparent that the average value of the quantities of the explosive substances required per one m$^3$ of the objectives to be fractured can be reduced by the practice of the present invention to one tenth of that required in the case of the conventional blasting methods, and, furthermore, no scattering of fragments of the broken object has been found in the case of the present invention.

According to the present invention, since the concrete structures, rocks, and base rocks can be cracked by a minimal quantity of explosives into desired sizes without the accompaniment of scattering of fragments of the concrete or rock, the blasting work can be carried out without causing any pollution problems either on land or in water.

In the case where unidirectional transmission of the explosive force is desired, either one of the reflecting plates 2A may be omitted, or either one of the peaks of the explosive substances 4 may be omitted, in each blasting device.

Although, in the above described example of the blasting equipment, the deflector 2 having two reflecting plates 2A, the explosive substance 4, and the incompressible fluid are all encased in the casing 3, it will be apparent that the advantageous effect of the present invention may also be obtained by modifications wherein an explosive substance and a casing containing an incompressible fluid, or an explosive substance and a casing containing an incompressible fluid and a deflector are provided as separate bodies.

I claim:

1. In a method for blasting a rock, a concrete structure, or a like object, which comprises boring a plurality of holes in the object; placing into each of said holes a cylindrical casing containing therein an incompressible fluid such as water, an explosive substance with an electric blasting cap, and electric conductors leading from said blasting cap outward for connection to an outside detonating device; tamping a stuffing into the opening of each hole; and then detonating said explosive substance thereby to generate a shock wave in said fluid; the improvement wherein said plurality of holes are bored in the object in a row and at positions spaced apart respectively by a specific distance; a deflector comprising two reflective concave-surfaces of semicircular cross-section mutually secured in back-to-back relation and containing an explosive substance at each of said reflecting surfaces is enclosed in each of said cylindrical casings; each of said casings containing therein respectively said deflector and explosive substance is inserted into each of said holes whereafter each of said holes is stuffed by tamping; and said explosive substances in all of said holes are exploded simultaneously thereby to fracture the object in the direction along which the shock wave is transmitted.

2. In a device for blasting a rock, a concrete structure or a like object, comprising a cylindrical casing having a closed bottom and a cap member and containing therein incompressible fluid such as water, an explosive substance with an electric blasting cap immersed in said fluid, and electric conductors leading from said blasting cap outward for connection to an outside detonating device, said casing being adapted to be inserted into a hole bored in the object and to be overlaid with a tamped stuffing when said object is to be blasted: the improvement wherein said cylindrical casing contains therein a deflector comprising two reflecting concave surfaces of seimcircular cross-section mutually secured in back-to-back relation, and wherein said explosive substance is provided at each of said reflecting surfaces.

3. A device according to claim 2, wherein said deflector is parallel to the longitudinal axis of said cylindrical casing and extends over substantially the length of the casing.

* * * * *